US009270036B2

(12) United States Patent
Casas Rodriguez

(10) Patent No.: US 9,270,036 B2
(45) Date of Patent: Feb. 23, 2016

(54) COUPLING DEVICE AND CONNECTOR FOR ENERGY CONDUCTION BY GROUNDING MECHANISM

(71) Applicant: Cobres de Colombia LTDA, Yumbo (CO)

(72) Inventor: Dolcey Casas Rodriguez, Cali (CO)

(73) Assignee: COBRES DE COLOMBIA LTDA, Valle del Cauca, Yumbo (CO)

( * ) Notice: Subject to any disclaimer, the term of this patent is extended or adjusted under 35 U.S.C. 154(b) by 0 days.

(21) Appl. No.: 14/251,084

(22) Filed: Apr. 11, 2014

(65) Prior Publication Data

US 2014/0342584 A1 Nov. 20, 2014

(30) Foreign Application Priority Data

Apr. 16, 2013 (CO) ..... 13-097704

(51) Int. Cl.

| | |
|---|---|
| ***H01R 13/648*** | (2006.01) |
| ***H01R 4/66*** | (2006.01) |
| ***H01R 4/36*** | (2006.01) |
| *H01R 4/10* | (2006.01) |

(52) U.S. Cl.
CPC .. *H01R 4/66* (2013.01); *H01R 4/36* (2013.01); *H01R 4/10* (2013.01); *Y10T 29/49208* (2015.01)

(58) Field of Classification Search
CPC ..... H01R 13/648; H01R 43/26; H01R 4/66; H01R 4/36; H01R 4/10
USPC ..... 439/92, 95–101; 29/876
See application file for complete search history.

(56) References Cited

U.S. PATENT DOCUMENTS 6,817,733 B2 * 11/2004 Frei et al. ..... 362/645

* cited by examiner

*Primary Examiner* — Javaid Nasri
(74) *Attorney, Agent, or Firm* — Ladas & Parry LLP

(57) ABSTRACT

A ground electrode-coupling device functionally joined to a cylindrical body, with internal cylindrical form and external conical form. The device includes an internal blockage dividing the device into two cavities. The device also includes at least an orifice in each cavity communicating the internal coupling with the external coupling, for enabling the release of the air by coupling the bodies. The external form is a conical geometry for reducing the resistance of the device by being inserted in a solid medium.

7 Claims, 12 Drawing Sheets

COUPLING DEVICE AND CONNECTOR FOR ENERGY CONDUCTION BY GROUNDING MECHANISM

DETAILED DESCRIPTION OF THE INVENTION

Figure 1:
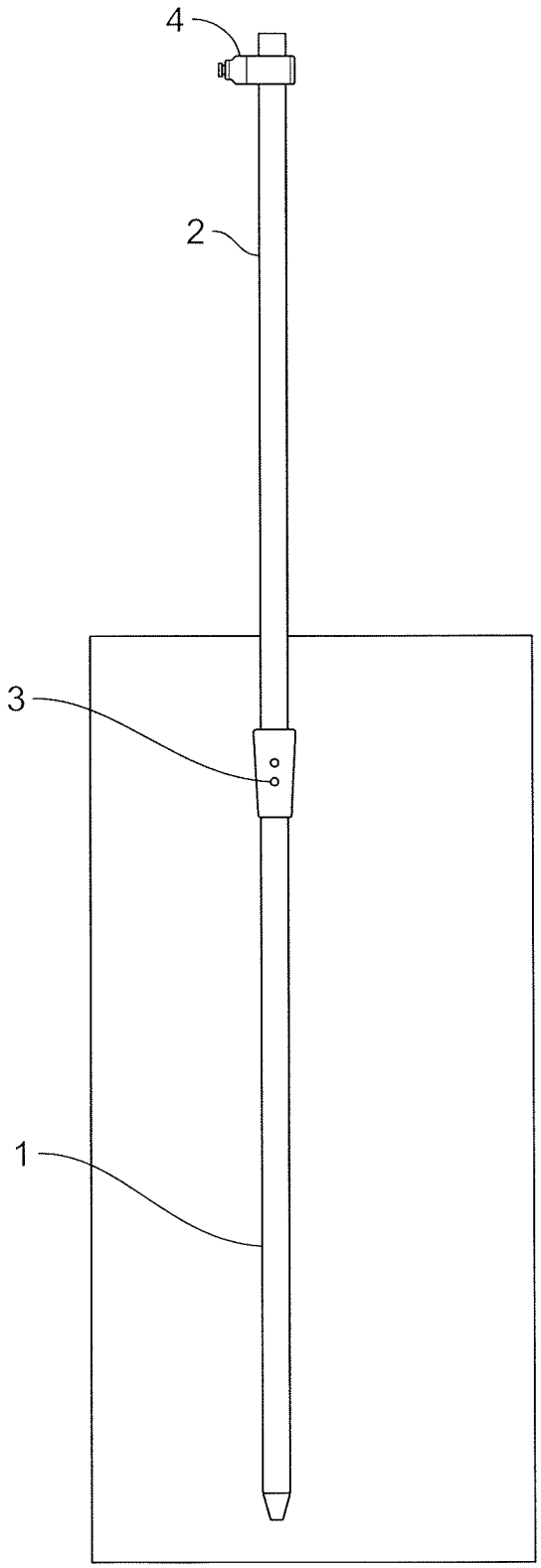
FIG. 1 shows a system comprising the components of the claimed invention that is partially inserted into the ground.
Figure 2:
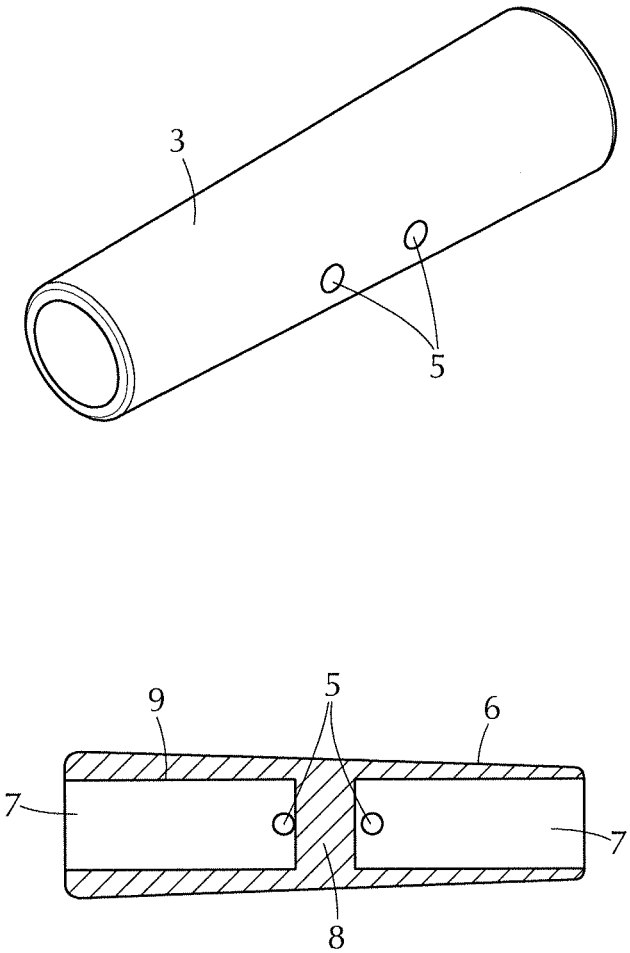
FIG. 2 shows a coupling device.
Figure 3:
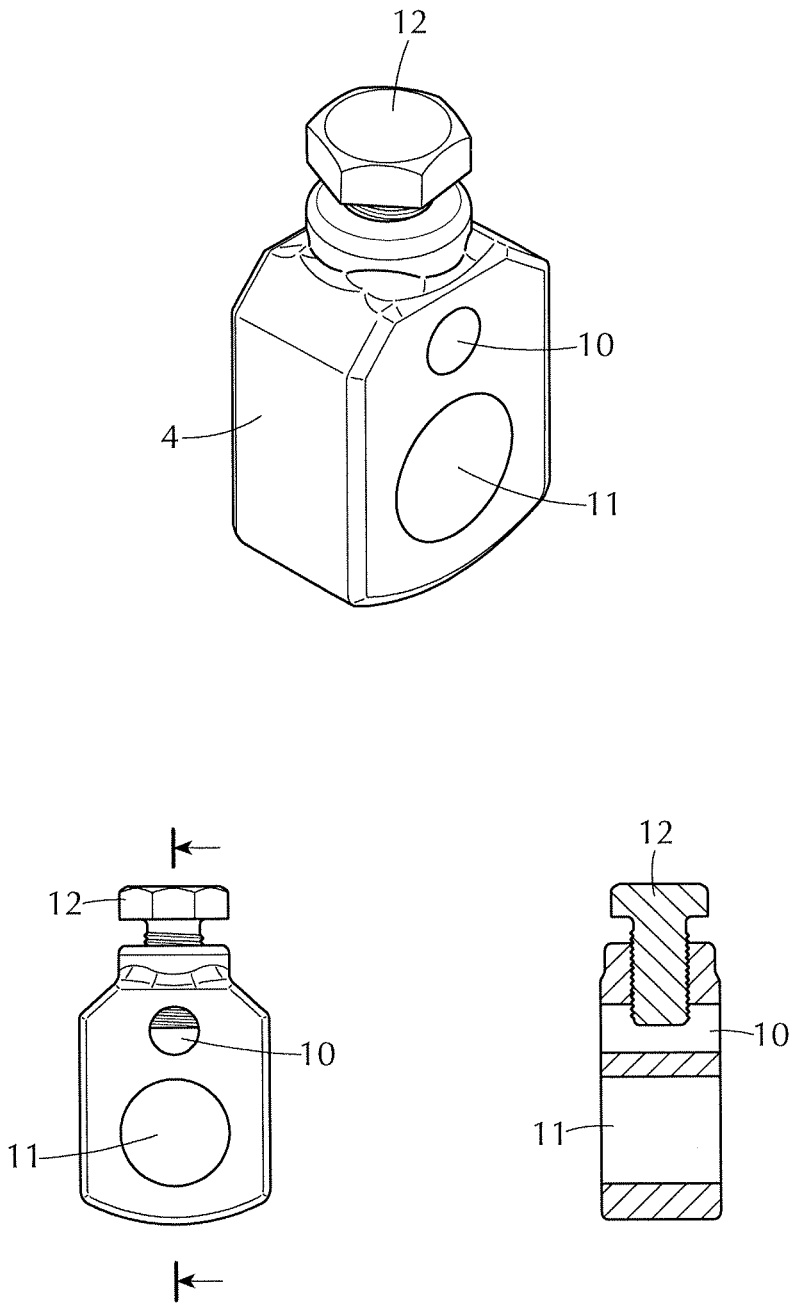
FIG. 3 shows a connecting device.
Figure 4:
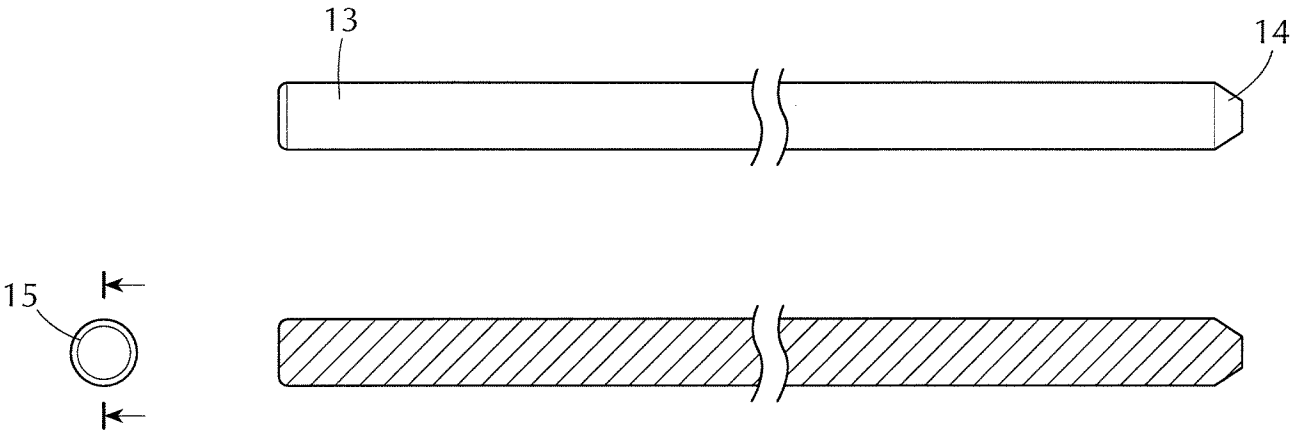
FIG. 4 shows a first cylindrical body.
Figure 5:
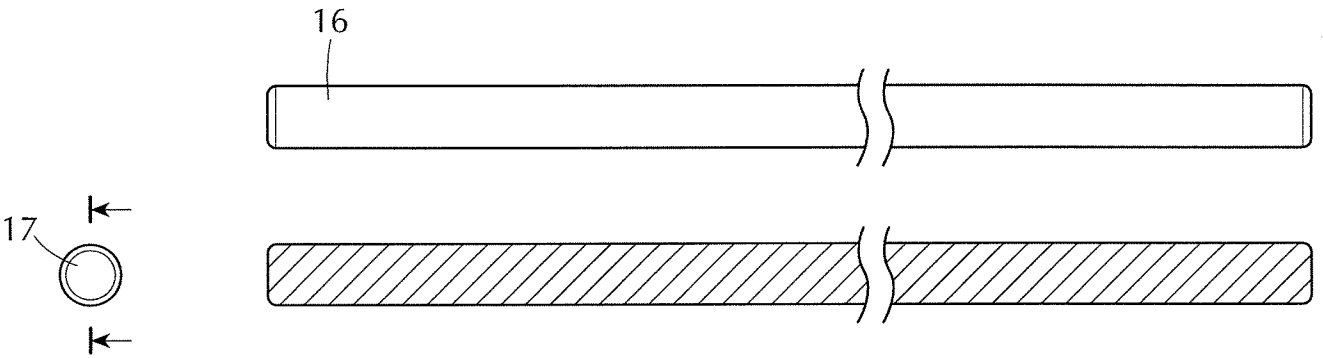
FIG. 5 shows a second cylindrical body.

The invention which patenting is being applied for is showed in FIG. 1, which consists of the creation of several system components allowing the provision of a solution to the exposed technical problems. The invention specifically consists of: a device with internal cylindrical form and external conical form (3), which is designed with a block in its interior (8) allowing the division of the device into two cavities (7). At least one hole is made to said device in each cavity communicating the internal coupling with the external coupling (5), for enabling the release of the air by coupling the bodies.

In the performed essays we could check that the external conical form of the coupling device (6) allows the reduction of the resistance thereof by being inserted on the floor.

The previous complementary artifact consists of a connection device (4) previewed for being functionally joined to the cylindrical body (2) for enabling an electrical solid connection there between. This functional joint is made by tight-fitting the connecting device (4) in the cylindrical body through a hole (11). The other hole has a smaller diameter (10) enabling the insertion of a ground conductor (19). The ground conductor is attached with a mobile piece preferably comprising one screw (12).

Both devices can be made of a metallic material selected from the group comprising copper, iron, steel, zinc, nickel, chrome and alloys thereof and combinations and coatings thereof.

Figure 6:
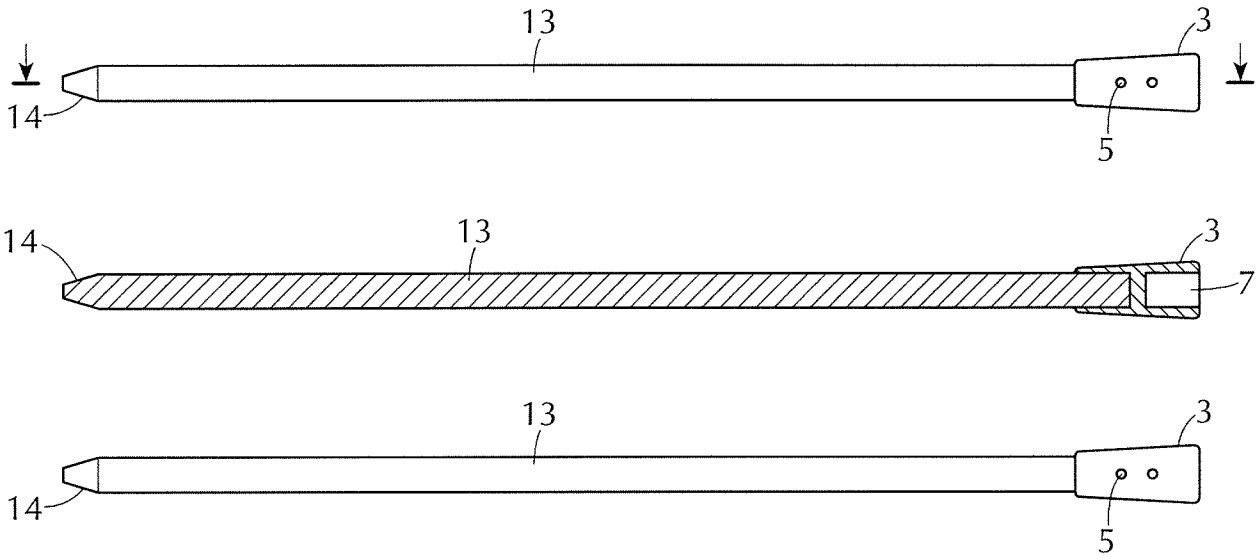
FIG. 6 shows a set comprising a first cylindrical body with at least one point end on to which the coupling device is inserted and pre-mounted.
Figure 7:
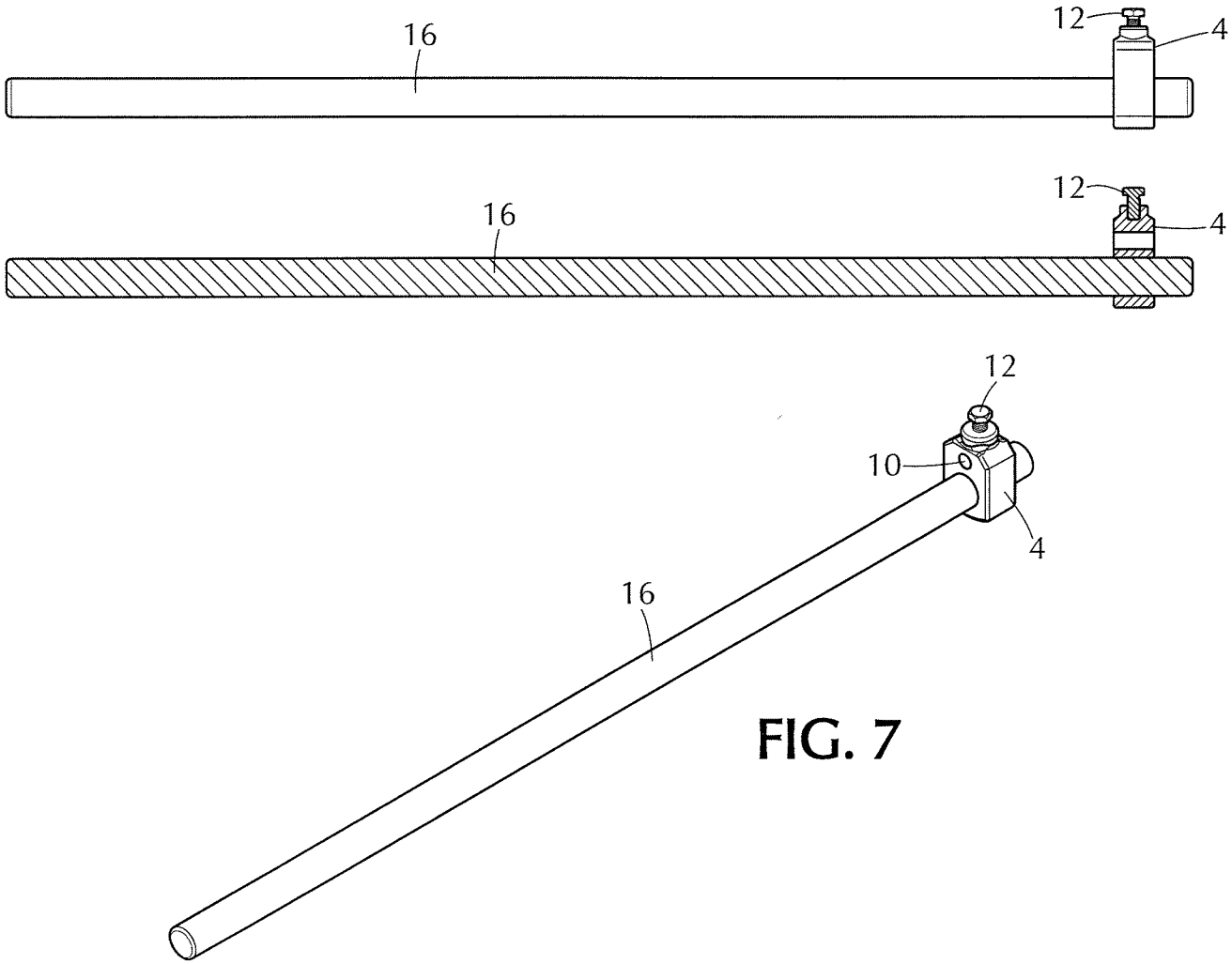
FIG. 7 shows a set comprising a second cylindrical body without a point end on to which the connecting device is inserted and pre-mounted.

The whole system can be presented as a group for providing a solution to the exposed logistical problems, thereby being as a kit of electrical ground conduction comprising: a first cylindrical body (1) with at least one point end (14), carrying the coupling device inserted and pre-mounted, on the end without a point end (3), forming the set of FIG. 6. A second cylindrical body (2), without point end, carrying the connecting device (4) inserted and pre-mounted, forming the set of FIG. 7, securing the electrical conduction between the cylindrical bodies and a conductor ground wire (19).

The cylindrical form of the cylindrical bodies (1, 2) is further showed in cross-section (15), (17).

Figure 8:
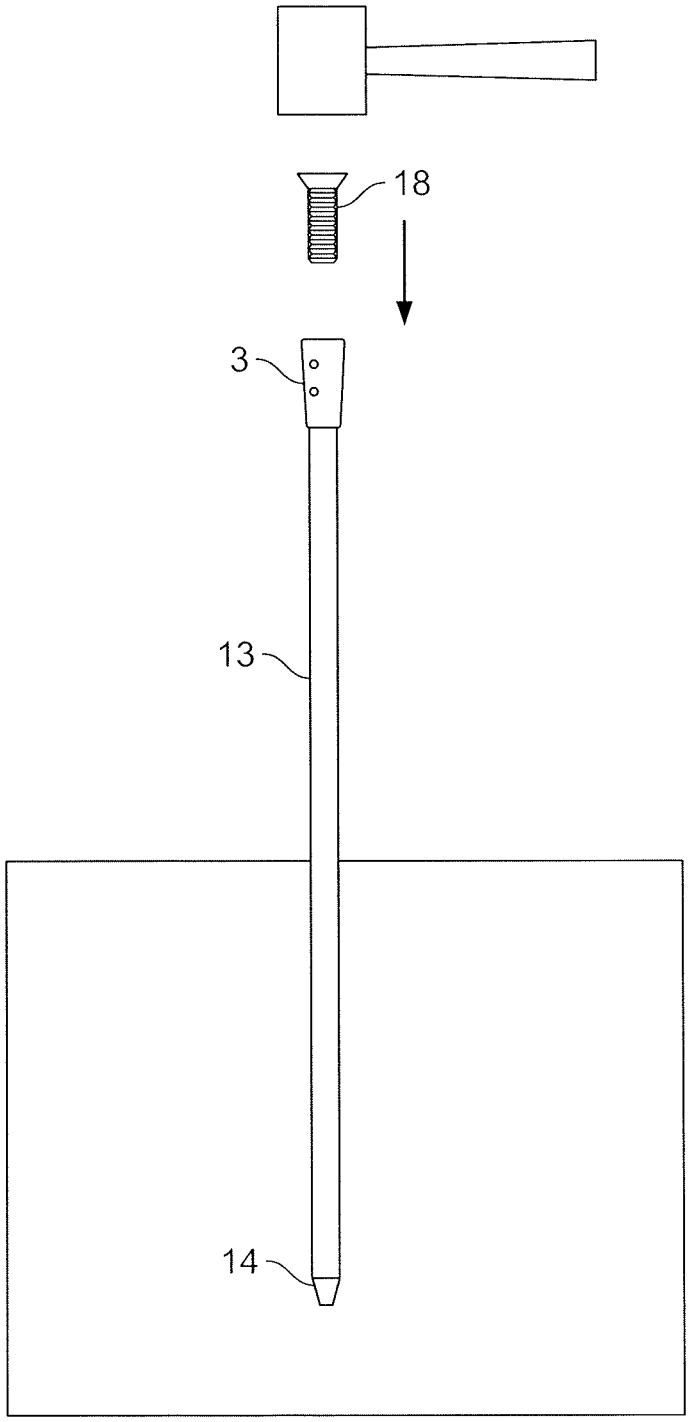
FIG. 8 shows the insertion of the first cylindrical body with attached coupling device into the ground.
Figure 9:
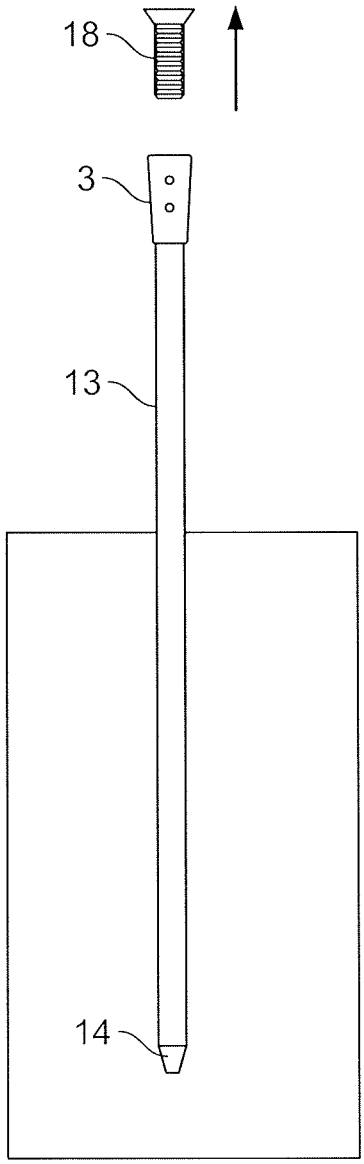
FIG. 9 shows the removal of a lip clamp from the first cylindrical body.
Figure 10:
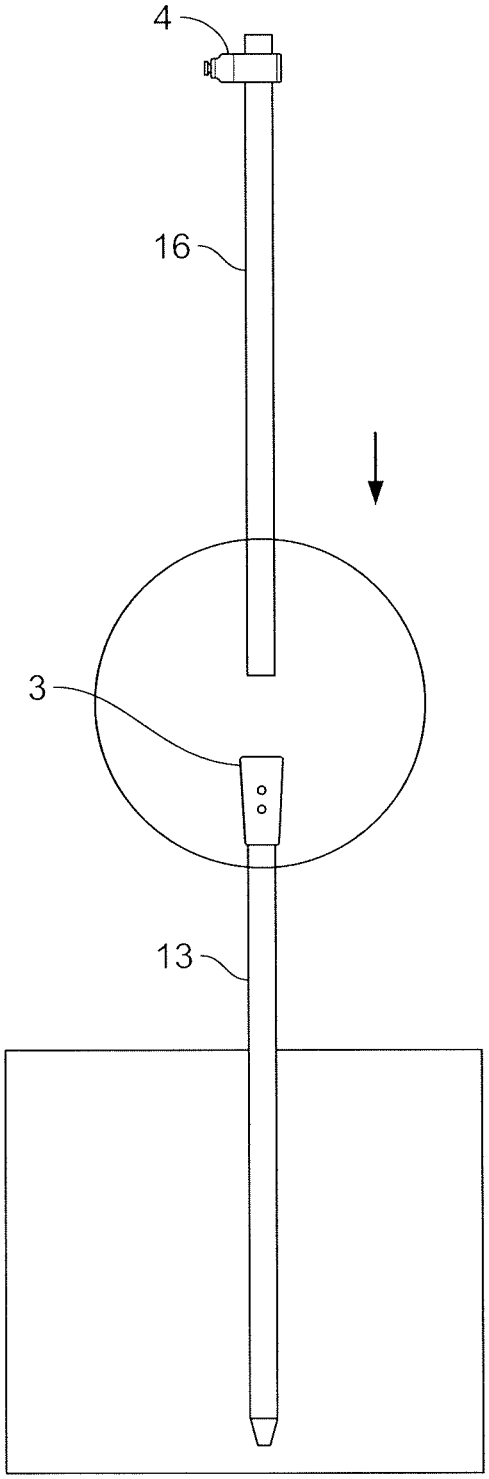
FIG. 10 shows the insertion of the second cylindrical body into the coupling device of the first cylindrical body.
Figure 11:
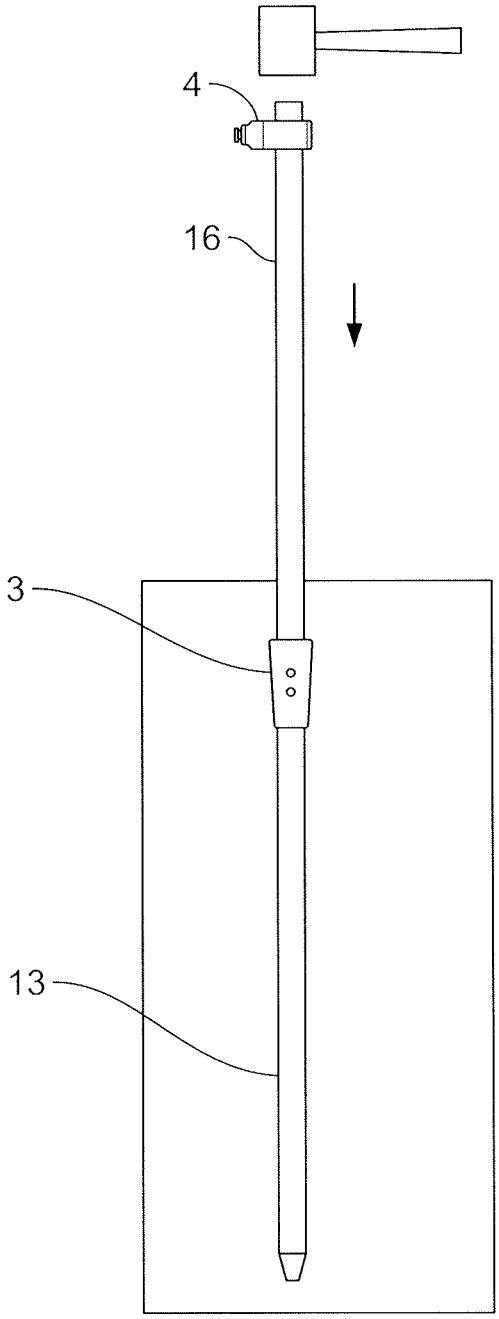
FIG. 11 shows the connection of the second cylindrical body with the first cylindrical body by impact.
Figure 12:
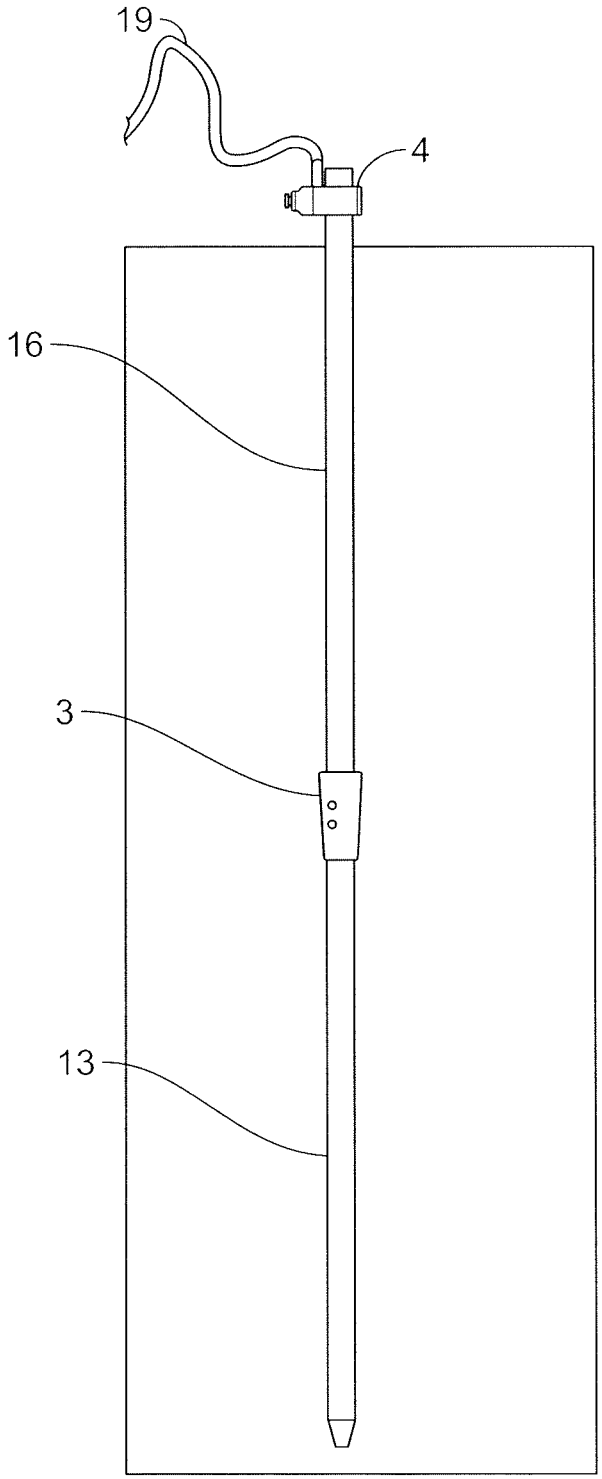
FIG. 12 shows a ground wire attached to the connecting device.

Adequately, the kit of the present invention and its components can be easily installed by means of a method illustrated in FIGS. 8 to 12 and which generally comprises the following steps: inserting the end facing the point end of the first cylindrical body (1) of one coupling (3), installing a lip clamp (18) in the opening of the coupling (3) such that it reaches the internal blockage of this device; inserting on the floor the first cylindrical body with point end by means of an impact to the end containing the lip clamp, as showed in FIG. 8, which is further reaffirmed for proceeding to the mounting of the second cylindrical body without point, as showed in FIGS. 9 and 10, in the free cavity of the coupling device (3). Before this process, the second cylindrical body without point end is inserted in one of the ends (16) of the connecting device (4). In this point the next step is subjecting the previous mounting to an impact for coupling to the two cylindrical bodies and their grounding, specifically as described in FIG. 11, letting the higher end projected about 15 cm; and finally the ground wire (19) is attached in the attaching orifice of the connecting device.

In the present invention, the coupling device (3) is characterized in that is made of a metallic material, which guarantees the electrical conduction, which is selected from the group comprising copper, steel, iron, zinc, aluminum, chrome, and alloys thereof, combinations or coatings thereof.

The present invention further provides a connecting device (4) for ground electrodes, which is functionally joined to a cylindrical body for enabling an electrical solid connection between them, comprising: at least an orifice of greater diameter for tight-fit insertion in the cylindrical body; at least an orifice of smaller diameter for the attaching of at least one conductor ground cable; and a mobile piece comprising a screw for attaching such conductor ground cable.

In the present invention, the connecting device (4) is characterized in that is made of a metallic material selected from the group comprising copper, iron, steel, zinc, aluminum, nickel, chrome and alloys thereof, combinations or coatings thereof.

The present invention further provides a kit of electrical ground conduction comprising: a first cylindrical body with point end on at least one of its ends; a second cylindrical body without point end joining to the first cylindrical body using the coupling device described above; a coupling device as the one above described, which performs the joining between such cylindrical bodies; a connection device as the one previously described, for enabling the electrical conduction between the joined cylindrical bodies and a conductor ground cable.

In another aspect of the present invention, the kit of electrical ground conduction is characterized in that the first cylindrical body and the second cylindrical body are made of a metallic material selected from the group comprising copper, iron, steel, zinc, aluminum, nickel, chrome and alloys thereof, combinations or coatings thereof.

The present invention provides a method for installing the kit of electrical ground conduction already described, illustrated in FIGS. 8 to 12 and which requires consecutively performing the following steps:

a. Inserting in the end facing the point end of the first cylindrical body already having the coupling incorporated, as the one above described, a lip clamp in the opening of the coupling such that it reaches the internal blockage of said device;

b. Inserting in the floor the first cylindrical body with point end, by means of an impact on the end containing the lip clamp;

c. Removing the lip clamp;

d. Mounting the second cylindrical body without point end and with an incorporated connector, on the cavity free of the coupling device;

e. Subjecting the previous mounting to an impact for coupling the two cylindrical bodies and reaching their sticking in the floor, letting the higher end projected about 10 to 15 cm;

f. Attaching a ground conductor in the attaching orifice of the connecting device.

For the effects of the present invention, a lip clamping (18) is: a protecting material which is placed over a stick to support and transmit an external impact, and enabling the immersion of such stick in the floor, preventing the deformation of one of its ends.

For the effects of the present invention, the floor is considered as the earth surface, and in a similar way it is understood as the set of organic and inorganic matters of the earth surface able to support vegetable life; the artificial surface made for the floor to be solid, and similar aspects.

For the effects of the present invention, and according to the definitions established in the Technical Code of Electrical Installations (RETIE for its Spanish abbreviation), a cable (19) is a set of non-isolated wires and braided by means of concentric layers. And a wire is a drawn-out or galvanized thread or metal filament for conducting electrical current.

The invention claimed is:

1. A ground electrode-coupling device for joining two cylindrical bodies, wherein the ground electrode-coupling device has an internal cylindrical form and an external conical form and comprises:

a. An internal blockage dividing the ground electrode-coupling device into two cavities; wherein a first cavity is for coupling a first cylindrical body and a second cavity is for coupling a second cylindrical body;

b. At least one orifice in each cavity for enabling the release of air inside each cavity;

c. wherein the external conical form comprises a conical geometry for reducing the resistance of the ground electrode-coupling device when being inserted into the ground.

2. The ground electrode-coupling device according to claim 1, wherein the ground electrode-coupling device is made of a metallic material selected from the group consisting of copper, steel, iron, zinc, aluminum, and chrome, and alloys thereof, and combinations and coatings thereof.

3. A ground electrode-coupling device for enabling an electrical solid connection between at least one ground conductor cable and a ground electrode comprising:

a. An orifice of a greater diameter for tight-fit insertion of a cylindrical body;

b. An orifice of a smaller diameter for insertion of at least one conductor ground cable; and c. A mobile piece comprising a screw for securing the at least one conductor ground cable to the ground electrode-coupling device.

4. The ground electrode-coupling device according to claim 3, wherein the ground electrode-coupling device is made of a metallic material selected from the group consisting of copper, steel, iron, zinc, aluminum, and chrome, and alloys thereof, and combinations and coatings thereof.

5. A kit of electrical ground conduction comprising:

a. A first cylindrical body with a pointed end;

b. A second cylindrical body without a pointed end;

c. A first coupling device for joining the first and second cylindrical bodies; wherein the first coupling, device has an internal cylindrical form and an external conical form and comprises an internal blockage dividing the first coupling device into two cavities, wherein a first cavity is for coupling the first cylindrical body and a second cavity is for coupling the second cylindrical body; at least one orifice in each cavity for enabling the release of air; wherein the external conical form comprises a conical geometry for reducing the resistance of the first coupling device when being inserted into the ground;

d. A second coupling device, for enabling electrical conduction between the joined first and second cylindrical bodies when joined together and at least one conductor ground cable; wherein the second coupling device comprises an orifice of a greater diameter for tight-fit insertion of the second cylindrical body; an orifice of a smaller diameter for insertion of the at least one conductor ground cable; and a mobile piece comprising a screw for securing the at least one conductor ground cable to the second coupling device.

6. The kit of electrical ground conduction according to claim 5, wherein the first cylindrical body and the second cylindrical body are made of a metallic material selected from the group consisting of copper, steel, iron, zinc, aluminum, and chrome, and alloys thereof, and combinations and coatings thereof.

7. A method for installing the kit of electrical ground conduction of claim 5 comprising the following steps:

a. Inserting in the first cavity of the first coupling device the first cylindrical body with the pointed end;

b. Inserting in the second cavity of the first coupling device a lip clamp such that the lip clamp reaches the internal blockage of the first coupling device;

c. Inserting the pointed end of the first cylindrical body into the ground by hammering the lip clamp;

d. Removing the lip clamp;

e. Mounting the second coupling device onto the second cylindrical body and inserting the second cylindrical body into the second cavity of the first coupling device;

f. Hammering the top of the second cylindrical body for coupling the first and second cylindrical bodies together and causing them to be inserted into the ground, letting an end of the second cylindrical body project about 10 to 15 cm from the ground;

g. Inserting at least one ground conductor cable in the orifice of a smaller diameter of the second coupling device and turning the screw of the second coupling device to secure the at least one ground conductor cable.

* * * * *